US009263211B2

(12) United States Patent
Weinreich

(10) Patent No.: US 9,263,211 B2
(45) Date of Patent: Feb. 16, 2016

(54) ELECTRICAL SWITCH WITH BUILT IN FUSE

(71) Applicant: Palle Kohring Weinreich, Ceiba, PR (US)

(72) Inventor: Palle Kohring Weinreich, Ceiba, PR (US)

( * ) Notice: Subject to any disclaimer, the term of this patent is extended or adjusted under 35 U.S.C. 154(b) by 301 days.

(21) Appl. No.: 13/961,930

(22) Filed: Aug. 8, 2013

(65) Prior Publication Data

US 2015/0042441 A1 Feb. 12, 2015

(51) Int. Cl.
*H01H 21/16* (2006.01)

(52) U.S. Cl.
CPC ..... *H01H 21/16* (2013.01); *H01H 21/165* (2013.01)

(58) Field of Classification Search
CPC ..... H01H 21/16; H01H 21/165
USPC ..... 337/1, 4, 8, 143
See application file for complete search history.

(56) References Cited

U.S. PATENT DOCUMENTS 3,123,692 A * 3/1964 Weber ..... 337/149
3,406,365 A * 10/1968 Lameyre ..... 337/211
3,800,259 A * 3/1974 Humphreys ..... 337/10
4,292,616 A 9/1981 Andersen
4,298,854 A * 11/1981 Andersen ..... 337/10
5,559,662 A * 9/1996 Happ et al. ..... 361/104
5,643,012 A * 7/1997 Mai et al. ..... 439/620.29
6,587,028 B2 * 7/2003 Mollet et al. ..... 337/194
6,650,222 B2 * 11/2003 Darr et al. ..... 337/187
6,717,505 B1 * 4/2004 Bruchmann ..... 337/194
6,734,580 B1 5/2004 Bruchmann
6,784,783 B2 * 8/2004 Scoggin et al. ..... 337/194
6,853,289 B2 * 2/2005 Scoggin ..... 337/194
7,019,612 B2 * 3/2006 Lin ..... 337/229
7,495,540 B2 * 2/2009 Darr et al. ..... 337/72
7,561,017 B2 * 7/2009 Darr et al. ..... 337/79
8,766,761 B2 * 7/2014 Schwabenland ..... 337/143

FOREIGN PATENT DOCUMENTS

DE 2913884 A1 * 10/1980 ..... H01H 21/16
EP 319606 A1 * 6/1989 ..... H01H 23/10

* cited by examiner

*Primary Examiner* — Anatoly Vortman
(74) *Attorney, Agent, or Firm* — Brian S. Steinberger; Law Offices of Brian S. Steinberger, P.A.

(57) ABSTRACT

An electrical switch having an activation component that closes and opens contact points within a switch housing. The activation component can include a front end and a rear end. The rear end can be within the switch housing and the front end can protrude from the switch housing. The front end of the activation component can include a fuse slot. A fuse can be placed in the fuse slot and removed from the fuse slot. A rubber cover can be removably attachable to the outside of the fuse slot to protect a fuse within the fuse slot.

11 Claims, 4 Drawing Sheets

ELECTRICAL SWITCH WITH BUILT IN FUSE

BACKGROUND OF THE INVENTION

The present invention relates to an electrical switch and, more particularly, to an electrical switch with a fuse in the handle portion.

Currently, toggle switches, momentary switches, or thermal circuit breakers are used. A switch is an electrical component that can break an electrical circuit, interrupting the current or diverting it from one conductor to another. Most switch applications are automotive or marine. The switches require two components, a switch and a fuse holder wired together. If a failure occurs typically a panel has to be opened to troubleshoot the components. This can be very difficult to accomplish, especially in a marine application.

Typically, thermal breakers can be used for marine application. Thermal breakers tend to be large and do not require fuses. However, it is difficult to pinpoint whether a failure is caused by a faulty thermal breaker or some other anomaly on the circuit. Further, thermal breakers have only one amp setting, which means that if the electrical load is changed, the breaker must be changed as well, which is costly.

Both thermal breakers and switches require additional components. Further, the breakers and switches are bulky, expensive, and difficult to install and troubleshoot while on a vehicle or vessel.

As can be seen, there is a need for an easy to use and compact switch.

SUMMARY OF THE INVENTION

In one aspect of the present invention, an electrical switch comprises: a switch housing comprising a plurality of contacts; an activation component having a front end and a rear end, wherein the front end protrudes from the switch housing and comprises a fuse slot formed to receive a fuse and the rear end leads into the electrical switch; a lead connected to the fuse slot and running into the switch housing and connected to at least one of the plurality of contacts, wherein the activation component can be placed in a closed position and an open position, wherein when the activation component is in the closed position at least two contacts are touching, and when the activation component is in the open position the plurality of contacts are separated.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an electrical switch having an activation component that closes and opens contact points within a switch housing. The activation component can include a front end and a rear end. The rear end can be within the switch housing and the front end can protrude from the switch housing. The front end of the activation component can include a fuse slot. A fuse can be placed in the fuse slot and removed from the fuse slot. A rubber cover can be removably attachable to the outside of the fuse slot to protect a fuse within the fuse slot.

The present invention can include a switch with a standard automotive fuse inserted in the toggle handle of the switch. Therefore, the present invention can eliminate the need for a separate fuse holder or associated wiring. The switch of the present invention can save space and may be simple to install. Further the present invention can be serviced easier than other switches available.

The present invention can be more compact than other switches and fuse combinations or thermal breakers typically found in marine applications. The present invention can reduce the probability of failure due to the reduction of components. The present invention can further facilitate troubleshooting without having to open electrical panels. Further, the amperage capacity can be changed without opening a panel.

Figure 1:
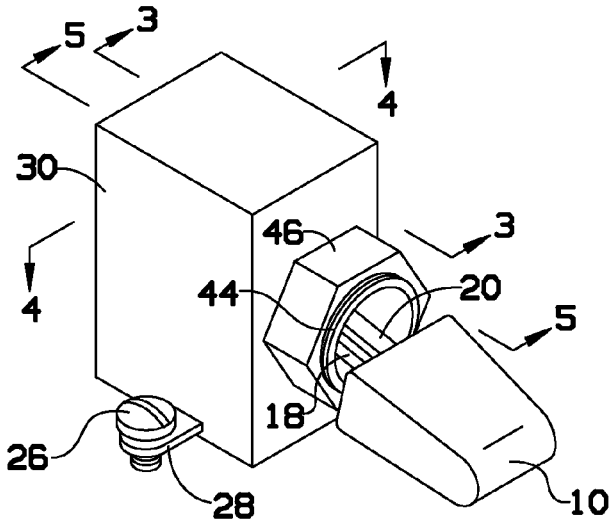
FIG. 1 is a perspective view of the present invention.
Figure 2:
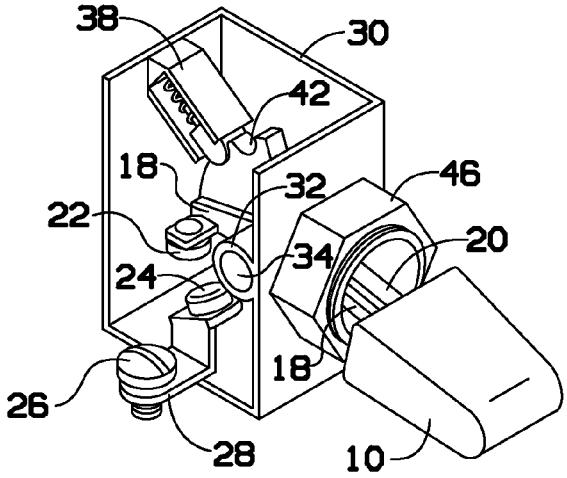
FIG. 2 is a perspective view of the present invention, with a top and side of the housing of FIG. 1. removed for clarity.
Figure 3:
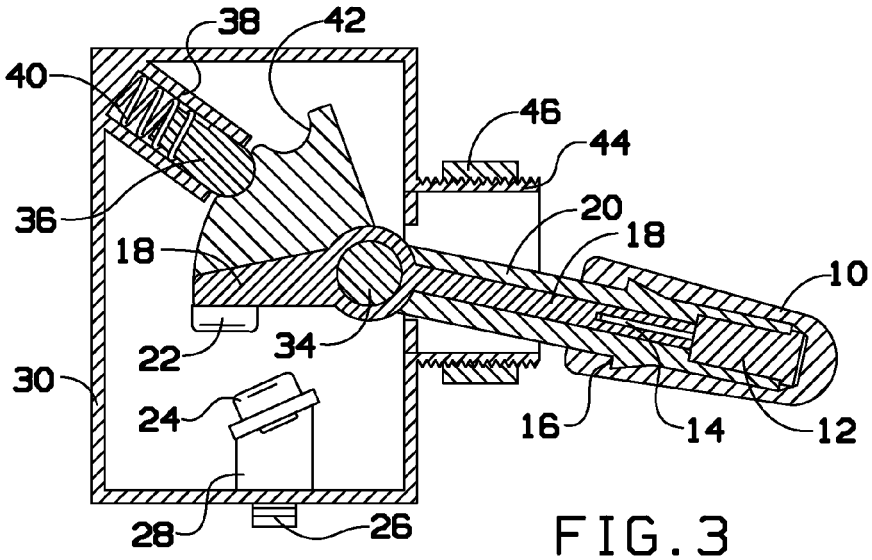
FIG. 3 is a section view of the present invention, taken along line 3-3 of FIG. 1.
Figure 4:
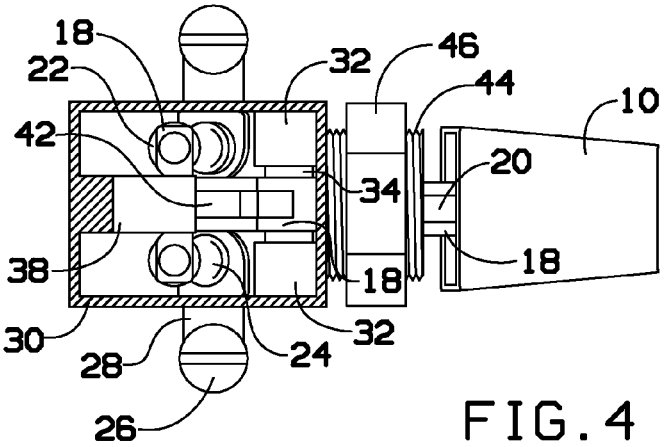
FIG. 4 is a section view of the present invention, taken along line 4-4 of FIG. 1.
Figure 5:
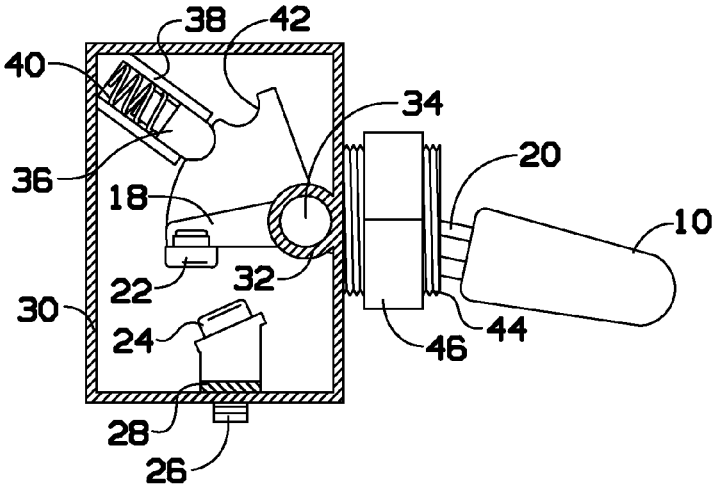
FIG. 5 is a section view of the present invention, taken along line 5-5 of FIG. 1.
Figure 6:
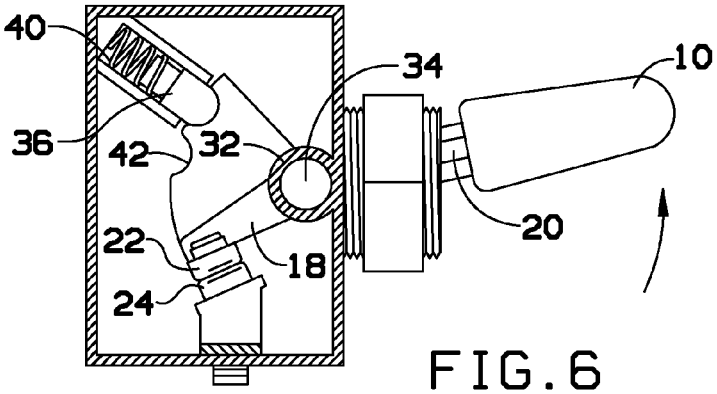
FIG. 6 is a section view of the present invention, illustrating the contacts of FIG. 5 in a closed position.
Figure 7:
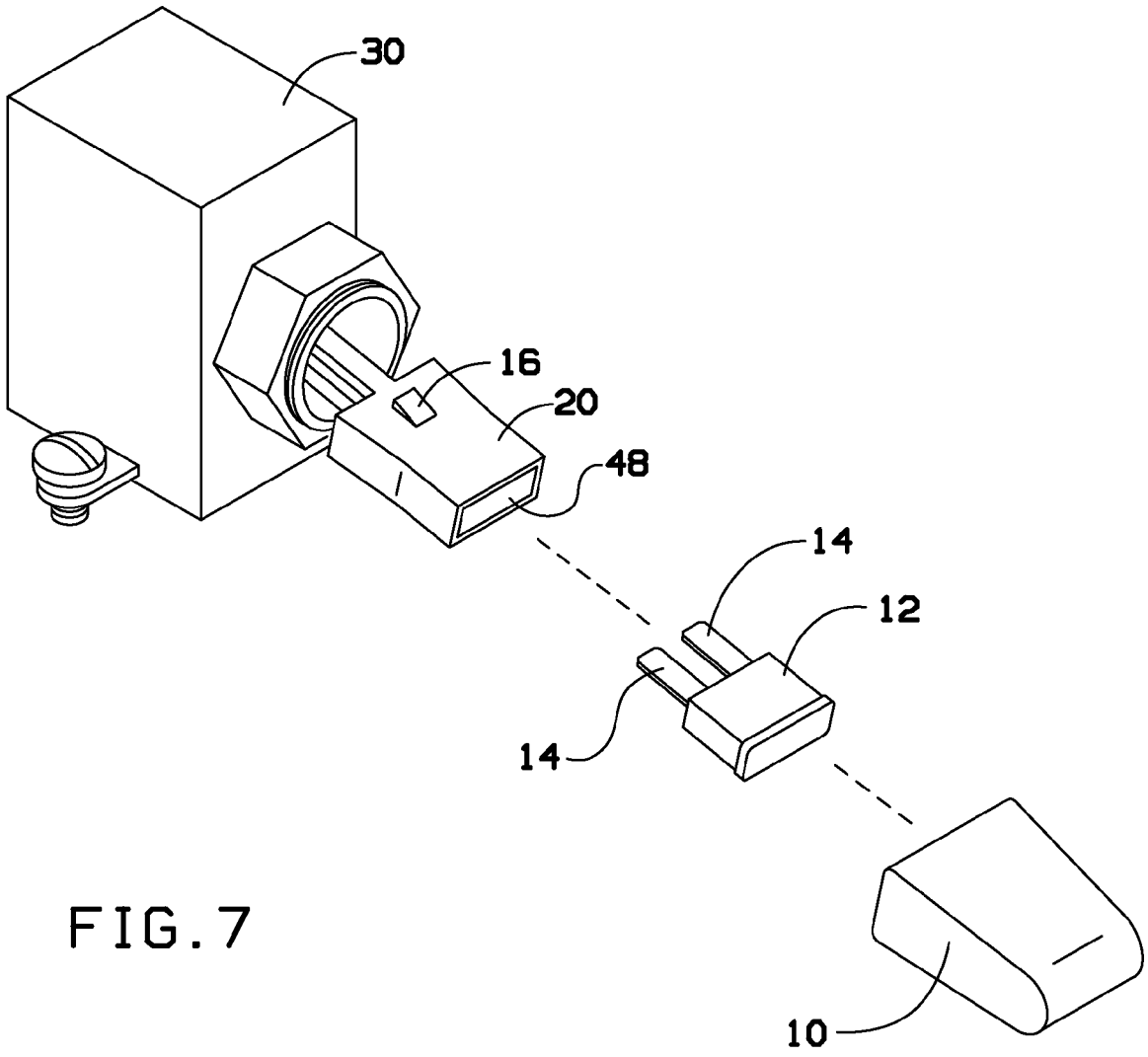
FIG. 7 is an exploded view of the present invention, illustrating the placement of the fuse and boot illustrated in FIG. 3
Figure 8:
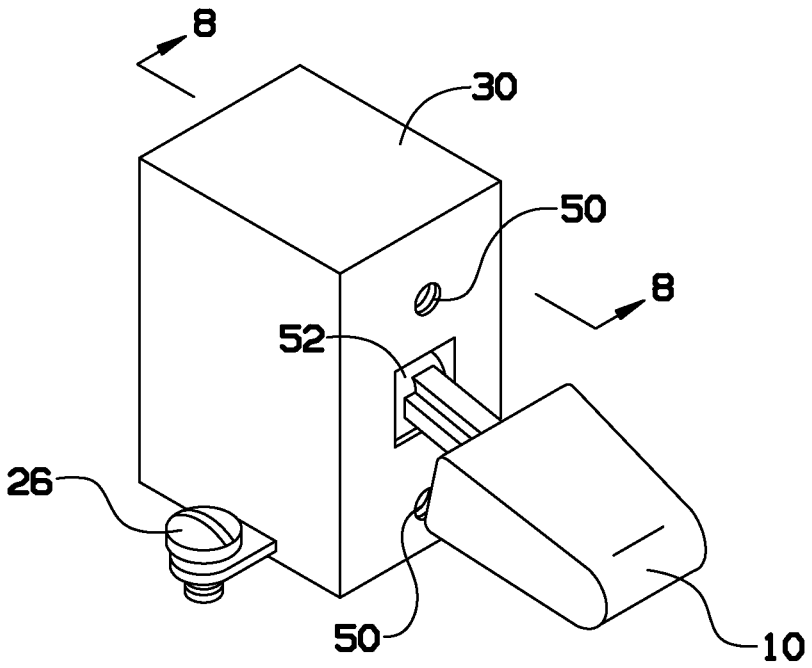
FIG. 8 is a perspective view of an alternate embodiments of the present invention.
Figure 9:
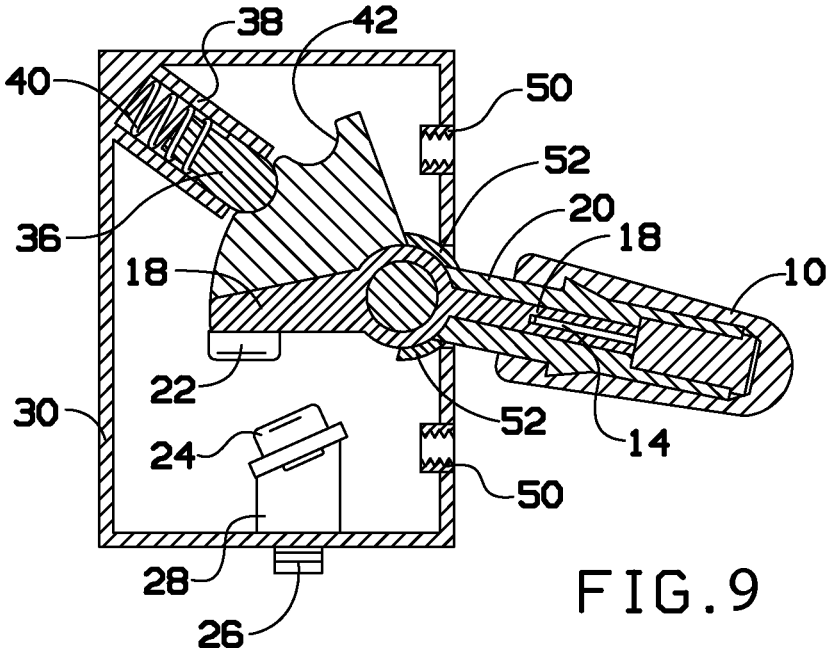
FIG. 9 is a section view of the present invention, taken along line 8-8 in FIG. 7.

Referring to FIGS. 1 through 9, the present invention can include an electrical switch. The electrical switch can include a switch housing 30 with a plurality of contacts 22, 24 within. The electrical switch can further include an activation component 54 having a front end and a rear end. The front end can protrude from the switch housing 30 and can include a fuse slot 48 formed to receive a fuse 12. The rear end of the activation component 54 can lead into the switch housing 30 . A lead 18 can connect the fuse slot 48 to at least one of the plurality of contacts 22.

As mentioned above, the fuse 12 can be inserted into the fuse slot 48. The fuse 12 can include fuse contacts 14. When the fuse 12 is inserted into the slot 48, the fuse contacts 14 can make contact with the lead 18. In certain embodiments, a boot 10 can fit over the fuse slot 48 and thereby act as a cover for the fuse 12. In such embodiments, the present invention can include a boot locking tab 16 to secure the boot 10 to the fuse slot 48. The boot 10 of the present invention can be a rubber boot 10 which can be easily removed to access the fuse 12.

As illustrated in the Figures, the activation component can include a toggle handle 20. However, the present invention is not limited to a toggle handle 20 and can include a push button, a lever, and the like. The rear end of the toggle handle 20 can include a pivot bar 34 that pivots along a pivot bar bearing 32 within the housing 30. The rear end of the toggle handle 20 can further include or be connected to tab slots 42 that can include at least a first tab slot 42 and a second tab slot 42. A locking tab 36 can fit within the tab slots 42. The locking tab 36 can be attached to a spring 40 contained within a locking tab chamber 38. The first tab slot 42 and second tab slot 42 can be adjacent to one another. Therefore, when the toggle handle 20 is pivoted along the pivot bar 34, the locking tab 36 can move from the first tab slot 42 to the second tab slot 42 or inversely from the second tab slot 42 to the first tab slot 42.

The activation component 54 can be placed in a closed position and an open position. The closed position can include the contacts 22, 24 touching each other. The open position can include the contacts 22, 24 separated from each other. As illustrated in the Figures, at least one moving contact 22 can be connected to the lead 18 extending from the toggle handle 20. At least one stationary contact 24 can be attached to wire leads 28 which can be attached to a wire attachment screw 26 protruding from the housing 30. When the activation component 54 is in the open position, the locking tab 36 can be within the first tab slot 42 and the moving contact 22 can be separated from the stationary contact 24. When the activation component 54 is in the closed position, the toggle handle 20 can be pivoted along the pivot bar 34 and the locking tab 36 can move from the first tab slot 42 to the second tab slot 42 connecting the moving contact 22 and the stationary contact 24. Thereby, pivoting the toggle handle 20 can lock the activation component 54 into the closed position, creating an electrical connection. Current can then flow toward the wire attachment screws 26.

The present invention can be attached to an electrical panel. In certain embodiments, the housing 30 can attach to the electrical panel by a retaining nut 46 which can be screwed to a threaded portion 44 of the housing 30. In certain embodiments, for marine application, the housing 30 can include threaded inserts 50, so that the housing 30 can be screwed and secured. The present invention can further include a seal 52. The activation component 54 can enter the housing 30 through an opening. The seal 52 can cover the opening and thereby prevent dust, water and the like, from entering the inside of the housing 30. This can be important for marina applications.

A method of using the present invention can include the following. With the present invention installed, if there is an electrical fault the user can remove the rubber cover from the toggle handle to inspect the inserted fuse. The user can check if the fuse is damaged by removing the fuse from the fuse insert. If the fuse is damaged, the fuse can show signs of a melted lead, and the user can be able to easily replace the fuse with a new one. Should the fault be in the electric wiring and not the fuse, the user can check the current flows by removing the rubber boot on the toggle handle and using a meter to check if the switch is getting the correct voltage input. Using the present invention, it is not necessary to unscrew and open the entire electric panel to check for voltage input.

Another advantage of the present invention can include changing the electrical load. For example, a stereo that needs only a 5 amp fuse can be changed to an electric marine toilet that needs a 20 amp fuse. The user can remove the rubber boot from the toggle handle, pull the existing 5 amp fuse out and insert the new 20 amp fuse. Therefore, the user does not need to change the entire switch.

It should be understood, of course, that the foregoing relates to exemplary embodiments of the invention and that modifications may be made without departing from the spirit and scope of the invention as set forth in the following claims.

What is claimed is:

1. An electrical switch comprising:

a switch housing comprising a plurality of contacts;

an activation component having a front end and a rear end, wherein the front end includes an elongated toggle handle which protrudes from the switch housing and comprises a fuse slot formed to receive a fuse and the rear end leads into the electrical switch;

a boot having a first position which fits over the fuse slot for covering both the fuse and the fuse slot, and a second position where the boot is removable to provide access to the fuse and the fuse slot;

a lead connected to the fuse slot and running into the switch housing and connected to at least one of the plurality of contacts, wherein the activation component is movable between a closed position and an open position, wherein when the activation component is in the closed position at least two of the plurality of contacts are touching each other, and when the activation component is in the open position the plurality of contacts are separated from each other.

2. The electrical switch of claim 1, wherein the activation component comprises a pivot bar that pivots along a pivot bar bearing.

3. The electrical switch of claim 2, further comprising a locking tab mechanism comprising a locking tab and a spring connected to the locking tab, wherein the activation component comprises a first tab slot and a second tab slot at the rear end, wherein the locking tab is formed to fit within the tab slots.

4. The electrical switch of claim 3, wherein the activation component is moveable between the open position with the locking tab within the first tab slot, and the close position with the locking tab within the second tab slot.

5. An electrical switch comprising:

a switch housing comprising a plurality of contacts;

an activation component having a front end and a rear end, wherein the front end protrudes from the switch housing and comprises a fuse slot formed to receive a fuse and the rear end leads into the electrical switch, wherein the activation component comprises a toggle handle connected to a pivot bar that pivots along a pivot bar bearing;

a lead connected to the fuse slot and running into the switch housing and connected to at least one of the plurality of contacts; and a locking tab mechanism comprising a locking tab and a spring connected to the locking tab, wherein the activation component comprises a first tab slot and a second tab slot at the rear end, wherein the locking tab is formed to fit within the tab slots, wherein the open position comprises the locking tab within the first tab slot, and the close position comprises the locking tab within the second tab slot, wherein the activation component is movable between a closed position and an open position, wherein when the activation component is in the closed position at least two of the plurality of contacts are touching each other, and when the activation component is in the open position the plurality of contacts are separated from each other, wherein the lead is part of the toggle handle and the lead comprises at least one moving in the closed position the moving contact and the stationary contact are touching each other and in the open position the moving contact and the stationary contact are separated from each other.

6. The electrical switch of claim 5, wherein the stationary contact is connected to a wire attachment protruding from the switch housing.

7. The electrical switch of claim 1, further comprising at least one threaded portion configured to attach the switch housing to an electrical panel.

8. The electrical switch of claim 1, wherein the rear end leads into the electrical switch through an opening in the switch housing.

9. The electrical switch of claim 8, further comprising a seal covering the opening of the switch housing.

10. The electrical switch of claim 1, wherein the elongated toggle handle includes:

a hook tab for locking the boot in the first position covering the fuse slot and the fuse.

11. An electrical switch, comprising:

a switch housing comprising a plurality of contacts;

an activation component having a front end and a rear end with a rear wall, wherein the front end includes an elongated toggle handle which protrudes from the switch housing and comprises a fuse slot having an open end and a rear end, the open end of the fuse slot formed to receive a fuse which abuts against the rear wall of the fuse slot, and the rear end leads into the electrical switch, wherein the fuse is removable by being pulled out of the open end of the slot; and a lead connected to the fuse slot and running into the switch housing and connected to at least one of the plurality of contacts, wherein the activation component is movable between a closed position and an open position, wherein when the activation component is in the closed position at least two of the plurality of contacts are touching each other, and when the activation component is in the open position the plurality of contacts are separated from each other.

* * * * *